US005108879A

United States Patent [19]

Abe et al.

[11] Patent Number: 5,108,879

[45] Date of Patent: Apr. 28, 1992

[54] METHOD FOR PROCESSING SILVER HALIDE PHOTOGRAPHIC MATERIALS

[75] Inventors: Akira Abe; Shinji Ueda, both of Kanagawa, Japan

[73] Assignee: Fuji Photo Film Co., Ltd., Kanagawa, Japan

[21] Appl. No.: 557,349

[22] Filed: Jul. 25, 1990

[30] Foreign Application Priority Data

Jul. 25, 1989 [JP] Japan ..... 1-190552

[51] Int. Cl.[5] ..... G03C 7/40

[52] U.S. Cl. ..... 430/429; 430/372; 430/421; 430/428

[58] Field of Search ..... 430/331, 372, 393, 421, 430/428, 429, 455, 460

[56] References Cited

U.S. PATENT DOCUMENTS

| | | | |
|---|---|---|---|
| 3,769,014 | 10/1973 | Stewart et al. | 430/428 |
| 4,451,132 | 5/1984 | Kishimoto | 430/398 |
| 4,500,517 | 2/1985 | Luss | 424/162 |
| 4,778,743 | 10/1988 | Ishikawa et al. | 430/372 |
| 4,933,264 | 6/1990 | Haseler et al. | 430/372 |
| 5,009,983 | 4/1991 | Abe | 430/372 |

FOREIGN PATENT DOCUMENTS

| | | | |
|---|---|---|---|
| 0186158 | 7/1986 | European Pat. Off. . | |
| 0294769 | 12/1988 | European Pat. Off. . | |
| 0344470 | 12/1989 | European Pat. Off. . | |
| 58-105150 | 6/1983 | Japan . | |
| 60-241053 | 11/1985 | Japan . | |
| 254151 | 11/1987 | Japan | 430/428 |

OTHER PUBLICATIONS

U.S. Application No. 07/554,998.

*Primary Examiner*—Hoa Van Le

*Attorney, Agent, or Firm*—Sughrue, Mion, Zinn, Macpeak & Seas

[57] ABSTRACT

A method for the processing of a silver halide photographic material is provided, which comprises the steps of;

developing a silver halide photographic material which has been previously exposed to light, processing the developed silver halide photographic material with a bath which contains a thiosulfate and which has a fixing ability, and subsequently subjecting the developed silver halide photographic material to washing and/or stabilizing in a multi-stage countercurrent process, wherein the multi-stage countercurrent process includes a reverse osmosis membrane and a washing solution and/or stabilizing solution, said solution containing at least one member selected from the group consisting of a sulfinic acid, a sulfinate and a carbonyl compound-bisulfurous acid addition product.

19 Claims, 2 Drawing Sheets

METHOD FOR PROCESSING SILVER HALIDE PHOTOGRAPHIC MATERIALS

FIELD OF THE INVENTION

The present invention relates to a method for processing a silver halide photographic material. More particularly, the present invention relates to a method for processing a silver halide photographic material which results in the constant formation of images having excellent properties without causing a drop in the permeable amount of solution or clogging in a reverse osmosis membrane. This latter benefit occurs even when the washing solution and/or stabilizing solution is continuously processed through the reverse osmosis membrane in a multi-stage countercurrent process. Furthermore, the present invention relates to a method for processing a silver halide photographic material which causes less environmental pollution and reduces the processing cost.

BACKGROUND OF THE INVENTION

The development of a photographic light-sensitive material normally involves (1) black-and-white development which comprises formation of silver images, (2) color development which comprises formation of color images or (3) a process which comprises black-and-white negative development, fogging, and color development to obtain reversal color images. The black-and-white development process normally comprises development, fixing, washing and/or stabilizing. The color development process normally comprises color development, desilvering, washing and/or stabilizing. In the washing process, chemicals and the like attached to the light-sensitive material are washed away. In the stabilizing process, an effect of stabilizing images, which is not given in the washing process, is provided. In order to effect such a washing process in a monobath so that images having excellent properties are constantly obtained, these chemicals need to be thoroughly washed away, requiring a large amount of washing solution. Similarly, in order to effect a stabilizing process in a monobath substantially without effecting a washing process so that images having excellent properties are constantly obtained, a large amount of stabilizing solution is needed. Such large amounts of processing solutions finally produce a large amount of waste fluid which causes an increase in the waste disposal cost and more environmental pollution.

Accordingly, in order to reduce environmental pollution and the cost of processing, including waste disposal, a method has been desired for maintaining excellent photographic properties while reducing the amount of processing solution to be used in the washing and/or stabilizing process. One of effective approaches has been a washing and/or stabilizing process in a multi-stage countercurrent process (See "Photographic Processing", November, 1979, pp. 29–32).

In this multi-stage countercurrent process, when the number of stages is increased, the amount of processing solutions to be used (replenishment rate of fresh solution) can be reduced while maintaining excellent photographic properties over a certain period of time. However, the increase in the number of stages causes an increase in the disposal and apparatus cost. Accordingly, the practical number of stages is limited. Even in such a practical multi-stage countercurrent washing and/or stabilizing process, if the continuous processing is effected over an extended period of time, excellent photographic properties cannot be maintained, causing an increase in yellow stain or the like.

In recent years, an approach has been proposed to process a washing solution and/or stabilizing solution through a reverse osmosis membrane for reuse so that the solution thus regenerated may reduce the replenishment rate of fresh solution while maintaining excellent photographic properties.

In the process described in JP-A-58-105150 (the term "JP-A" as used herein means an "unexamined published Japanese patent application"), the overflow solution from the washing tank is processed through a reverse osmosis membrane. The solution which has been purified through the reverse osmosis membrane is returned to the washing tank for reuse while the solution thus concentrated is returned to the prebath of the washing tank, i.e., blix tank. Thus, the blix agent carried by the light-sensitive material can be reused, enabling a reduction in the replenishment rate of fresh solution. Accordingly, the desilvering properties in the blix tank can be improved, inhibiting stain on the edge of the light-sensitive material.

The approach disclosed in JP-A-60-241053 is a modification of the above approach disclosed in JP-A-58-105150. In this modified approach, the solution to be processed through the reverse osmosis membrane is merely changed from the washing solution to a stabilizing solution. It is asserted in the reference that this approach allows a reduction in yellow stain both after a prolonged storage and shortly after processing.

However, the reverse osmosis membranes disclosed in these patents need a large area and a high pressure such as 40 to 55 kg/cm$^2$. Accordingly, these reverse osmosis membranes are disadvantageous in that they require an expensive pressure pump to operate, thereby increasing the apparatus cost and making it difficult to put them into practical use except in some large-scale laboratories. These reverse osmosis membranes are also disadvantageous in that such high pressure causes a rise in the temperature of the solution which has permeated therethrough, deteriorating the photographic properties to be processed.

In order to eliminate these defects caused by a high pressure, JP-A-62-254151 proposes a processing method in which the overflow solution from the washing tank or the stabilizing tank is received by a reservoir, and the solution collected in the reservoir is recirculated through a reverse osmosis membrane at a pressure lower than the ordinary value so that the solution is concentrated. In this method, the pressure at which the solution is subjected to reverse osmosis can be reduced to a relatively low value such as 14 to 20 kg/cm$^2$.

However, such an approach is disadvantageous in that if a low pressure reverse osmosis is continuously effected over an extended period of time, it causes a drop in the permeable amount of solution and clogging in the reverse osmosis membrane, which rarely take place in a high pressure reverse osmosis.

Few if any approaches for inhibiting clogging in the reverse osmosis membrane have been known except the approach described in JP-A-62-254151 which comprises the use of a chelating agent. In this approach, a chelating agent is used to inhibit clogging in the reverse osmosis membrane from the calcium or magnesium originally present in the washing solution or eluted from the light-sensitive material.

However, this approach resides in the regeneration of the washing solution and/or stabilizing solution through a reverse osmosis membrane at a relatively moderate pressure. It is found disadvantageous in that if it is applied to low pressure reverse osmosis, it initially gives less of a drop in the permeable amount of solution and less clogging in the reverse osmosis membrane but causes a drop in the permeable amount of solution and clogging in the reverse osmosis membrane after a prolonged continuous operation.

All the above-mentioned high pressure, middle pressure and low pressure reverse osmosis processes involve a drop in the permeable amount of solution and clogging in the reverse osmosis membrane, more or less. For example, some reverse osmosis processes do not cause these problems after couple of weeks of continuous operation but cause noticeable problems after a continuous operation for an extended period of times such as one month. There has been a desire to find a basic solution to these problems.

These reverse osmosis processes also cause troubles in the photographic properties of images thus obtained, particularly yellow stain shortly after processing and after storage. These high pressure, middle pressure and low pressure reverse osmosis membrane processes cause some deterioration in the photographic properties of images thus obtained after a prolonged continuous operation more or less. Thus, it has been desired to provide a process which constantly enables the formation of images having excellent photographic properties even after a prolonged continuous operation.

SUMMARY OF THE INVENTION

Therefore, an object of the present invention is to provide a method for processing a silver halide photographic material which inhibits the drop in the permeable amount of solution and clogging in the reverse osmosis membrane even if the processing solution is regenerated through the reverse osmosis membrane in a multi-stage countercurrent washing and/or stabilizing step.

Another object of the present invention is to provide a method for processing a silver halide photographic material which allows the constant formation of images having excellent photographic properties while inhibiting yellow stain shortly after processing and after storage even in a prolonged continuous operation.

A further object of the present invention is to provide a method for processing a silver halide photographic material which causes little environmental pollution and results in a reduction in the apparatus cost and disposal cost.

These and other objects of the present invention will become more apparent from the following detailed description and examples.

These objects of the present invention are accomplished by a process for processing a silver halide photographic material which comprises the steps of;

developing a silver halide photographic material which has been previously exposed to light, processing the developed silver halide photographic material with a bath which contains a thiosulfate and which has a fixing ability, and subsequently subjecting the developed silver halide photographic material to washing and/or stabilizing in a multi-stage countercurrent process, wherein the multi-stage countercurrent process includes a reverse osmosis membrane and a washing solution and/or stabilizing solution, said solution containing at least one member selected from the group consisting of a sulfinic acid, a sulfinate and a carbonyl compound-bisulfurous acid addition product.

DETAILED DESCRIPTION OF THE INVENTION

Figure 1:
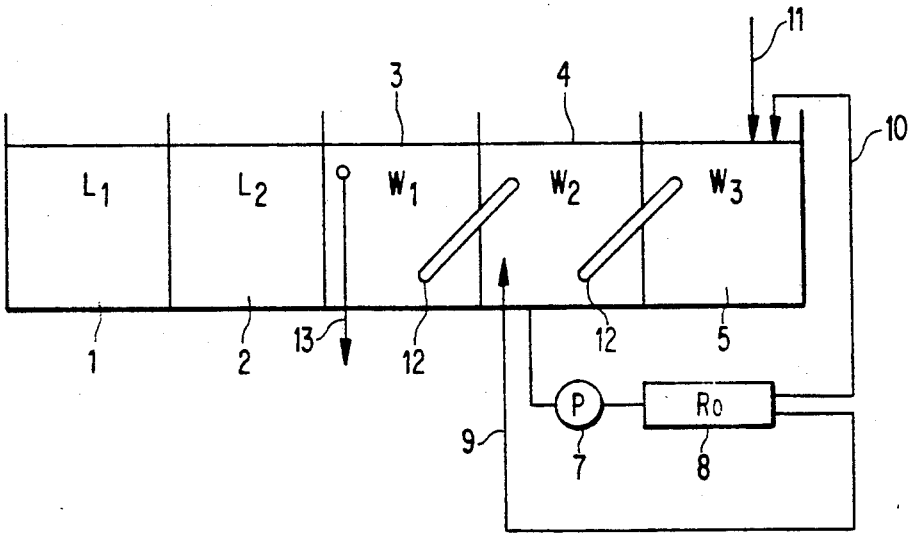
FIGS. 1, 2 and 3 illustrate a schematic view of an automatic developing machine in which a reverse osmosis membrane is mounted.

The present invention will be further described hereinafter.

As mentioned above, when the washing solution and/or stabilizing solution is repeatedly regenerated through a reverse osmosis membrane, it causes a drop in the permeable amount of the solution, clogging in the reverse osmosis membrane and deterioration in the photographic properties after a prolonged continuous operation.

Since a reverse osmosis membrane is a molecular filter, a high pressure is needed to cause a processing solution to permeate therethrough. Therefore, the reverse osmosis membrane is susceptible to clogging with components which have been filtered off and accumulated or attached thereto after prolonged operation. The drop in the permeable amount of solution is not always caused by physical clogging in the pores in the reverse osmosis membrane. Other possible causes include a reduction in the diameter of the pores in the reverse osmosis membrane caused by a change in the composition of the membrane such as a change in the properties of the surface of the membrane after prolonged operation (e.g., crosslinking of the surface of the membrane caused by a change in the modification degree).

There are many possible causes of clogging in a reverse osmosis membrane. For example, gelatin (particularly calcium or magnesium contained in gelatin) eluted from light-sensitive material attaches to the reverse osmosis membrane and causes clogging therein. Furthermore, various chemicals having a relatively high molecular weight such as the sensitizing dyes incorporated in the light-sensitive material are eluted, attach to the reverse osmosis membrane and cause clogging therein. Moreover, various chemicals in each processing tank, such as the development, bleaching and fixing tanks, are carried into the washing solution and/or stabilizing solution together with the light-sensitive material and cause clogging in the reverse osmosis membrane. Further, the washing solution and/or stabilizing solution causes propagation of a large amount of bacteria which causes clogging in the reverse osmosis membrane.

As a result of studies, the inventors have found that the clogging in the reverse osmosis membrane is primarily caused by finely divided silver sulfate grains produced by the sulfation of silver thiosulfate carried into the washing solution and/or stabilizing solution together with the light-sensitive material from the fixing bath or blixing bath.

The fixing or blixing bath normally contains thiosulfate as a fixing agent.

The inventors found that silver is dissolved in thiosulfuric acid contained in the fixing or blixing bath to produce silver thiosulfate which is then carried into the washing bath and/or stabilizing bath together with the light-sensitive material and decomposed to finely divided silver sulfate grains after a prolonged storage therein. In particular, if the replenishment rate of the washing solution and/or stabilizing solution is reduced, silver thiosulfate carried into these baths is retained therein over a longer period of time, increasing the amount of silver sulfate thus produced.

Finely divided silver sulfate grains thus produced cause clogging in the pores in the reverse osmosis membrane and become a major cause of the drop in the permeable amount of water.

In order to inhibit the decomposition of silver thiosulfate, sulfinic acid, sulfinate or carbonyl compound-bisulfurous acid addition product is used in the present invention. The use of such a compound enables effective inhibition of the decomposition of silver thiosulfate and the production of silver sulfate in the washing bath and/or stabilizing bath, making it possible to inhibit clogging in the reverse osmosis membrane.

The fixing solution or blix solution normally contains a sulfite as a preservative for silver thiosulfate. This sulfite is carried into the washing solution and/or stabilizing solution together with the light-sensitive material. However, it was found that most of the sulfite carried into the washing solution and stabilizing solution rapidly undergoes air oxidation and decomposition before it may inhibit the decomposition of silver thiosulfate. Thus, sulfites cannot effectively serve as a preservative for the washing solution and stabilizing solution. In particular, if it is desired to use sulfites to serve as an effective preservative for the washing solution and stabilizing solution, such sulfites are needed in a very large amount. The amount of the sulfite to be carried into the washing solution and stabilizing solution together with the light-sensitive material from its prebath, i.e., fixing bath or blixing bath is insufficient. Furthermore, even if a large amount of sulfite is incorporated in the washing solution and stabilizing solution, it cannot effectively work because it undergoes a rapid decomposition due to air oxidation.

It was found that the sulfinic acid, sulfinate or carbonyl compound-bisulfurous acid addition product to be used as a preservative in the present invention is very slow in air oxidation to gradually releases a sulfite which can serve as a very effective preservative for the inhibition of silver thiosulfate carried into the washing solution and stabilizing solution over an extended period of time.

Furthermore, sulfinic acid, sulfinate or carbonyl compound-bisulfurous acid addition product is contained in the solution thus concentrated through the reverse osmosis membrane. In the present process, the concentrated solution is returned to the bath where the reverse osmosis membrane is installed so that the preservative can be maintained in the bath where the reverse osmosis membrane is installed in a desired amount. Thus, the present invention contemplates an effective inhibition of sulfation of silver thiosulfate in the washing bath and/or stabilizing bath where the reverse osmosis membrane is installed and of clogging in the reverse osmosis membrane.

The processing solution which has permeated through the reverse osmosis membrane contains less preservative. However, since the solution which has permeated through the reverse osmosis membrane is supplied to a bath following the bath where the reverse osmosis membrane is installed, the amount of silver thiosulfate carried together with the light-sensitive material is small enough, causing little or no sulfation of silver thiosulfate.

In the present invention, the washing bath and/or stabilizing bath contains at least one of a sulfinic acid, a sulfinate and a carbonyl compound-bisulfurous acid addition product.

The sulfinic acid to be used in the present processing process will be further described hereinafter.

The present sulfinic acid is a compound in which at least one $—SO_2H$ group is connected to an aliphatic group, aromatic group or heterocyclic group.

The term "aliphatic group" as used herein means a straight-chain, branched or cyclic alkyl, alkenyl or alkinyl group which may be further substituted by substituents (e.g., ethyl, t-butyl, sec-amyl, cyclohexyl, benzyl). The aliphatic group which may contain substituents has generally from 2 to 30 carbon atoms, preferably from 3 to 20 carbon atoms and more preferably from 4 to 15 carbon atoms. The aromatic group may be either a carbon ring aromatic group (e.g., phenyl, naphthyl) or a heterocyclic aromatic group (e.g., furyl thienyl, pyrazolyl, pyridyl, indolyl). The aromatic group may be monocyclic or condensed (e.g., benzofuryl, phenanthridinyl). The aromatic group may contain substituents such as an alkyl group (e.g., methyl, ethyl, t-pentyl, octyl), an alkoxy group (e.g., methoxy, n-octoxy, hydroxyethoxy), an aryl group (e.g., phenyl), an aryloxy group (e.g., phenoxy), an alkoxycarbonyl group (e.g., methoxycarbonyl, t-octoxycarbonyl), a carbamoyl group (e.g ., methylcarbamoyl, t-octylcarbamoyl), an acylamino group (e.g., acetylamino), a nitro group, a hydroxy group, a halogen atom (e.g., Cl, Br) and a carboxy group. The aromatic group which may contain substituents has generally from 4 to 40 carbon atoms, preferably from 5 to 30 carbon atoms and more preferably from 6 to 25 carbon atoms, provided that a sulfinic acid polymer is exceptional.

The above described heterocyclic group is preferably in the form of a 3- to 10-membered cyclic structure formed of carbon, .oxygen, nitrogen, sulfur or hydrogen atoms. The heterocyclic group may be saturated or unsaturated. The heterocyclic group may be further substituted by substituents (e.g., coumenyl, pyrrolidinyl, pyrrolinyl, morpholinyl).

Examples of sulfinate which can be used in the present invention include salts of the above-mentioned sulfinic acids with alkali metals, alkaline earth metals, nitrogen-containing organic bases or ammonia. Examples of such alkali metals include Na, K, and Li. Examples of such alkaline earth metals include Ca, and Ba. Examples of such nitrogen-containing organic bases include ordinary amines capable of forming a salt with sulfinic acid. If the sulfinate contains a plurality of $—SO_2H$ groups in its molecule, some or all of these $—SO_2H$ groups may be in the form of salt.

The sulfinic acid is preferably a compound in which $—SO_2H$ groups are connected to an aromatic or heterocyclic group in light of their effect of inhibiting stain. The sulfinic acid is preferably in the form of salt with alkali metal, alkaline earth metal, nitrogen-containing organic base or ammonium. More preferably, the sulfinic acid is a compound in which $—SO_2H$ groups are connected to an aromatic group, particularly in the form of salt with alkali metal or alkaline earth metal. In other words, a salt of aromatic sulfinic acid with alkali metal or alkaline earth metal can be preferably used.

If $—SO_2H$ groups are connected to a phenyl group as substituents of the phenyl group, it is preferable to use combinations of substituents wherein the sum of Hammet's values is 0.0 or more.

Furthermore, sulfinic acids preferably containing 30 or less, particularly 25 or less, carbon atoms depending on the number of hydrophilic substituents, or the salts or precursors thereof can be used in light of their solubility in water.

Specific examples of sulfinic acids and salts thereof which can be used in the present invention are set forth below:

S-1

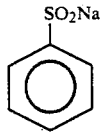

S-2

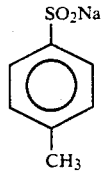

S-3

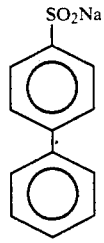

S-4

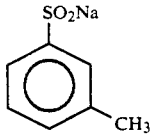

S-5

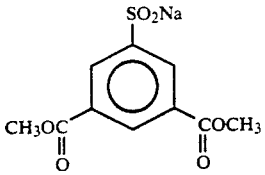

S-6

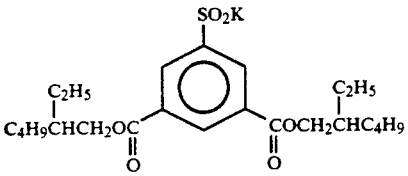

S-7

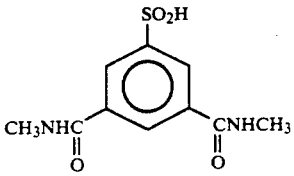

-continued

S-8

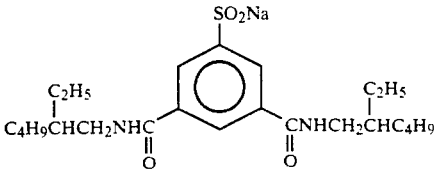

S-9

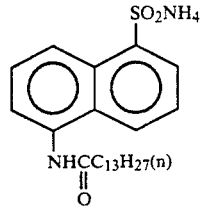

S-10

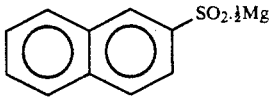

S-11

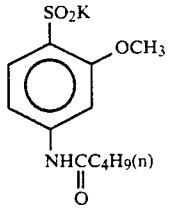

S-12

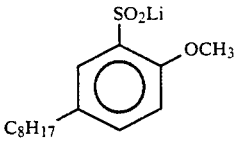

S-13

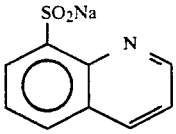

S-14

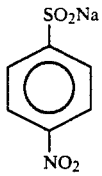

S-15

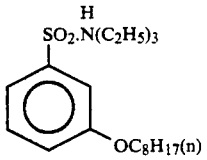

S-16

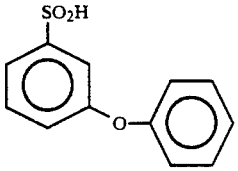

S-17

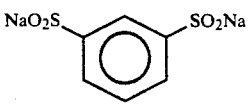

-continued
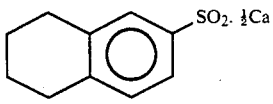
S-18
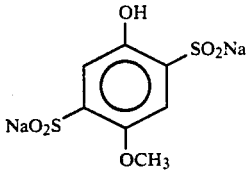
S-19
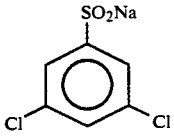
S-20
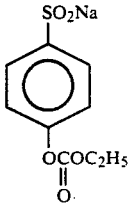
S-21
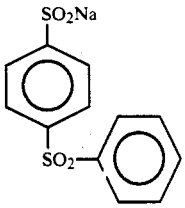
S-22
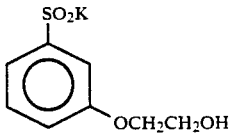
S-23
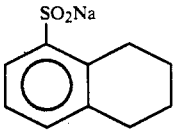
S-24
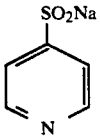
S-25
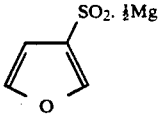
S-26
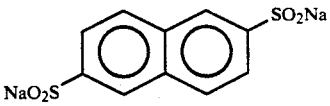
S-27
$(n)C_4H_9SO_2Na$
S-28
-continued
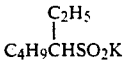
S-29
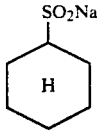
S-30
$CH_3OCH_2CH_2OCH_2CH_2SO_2NH_4$
S-31
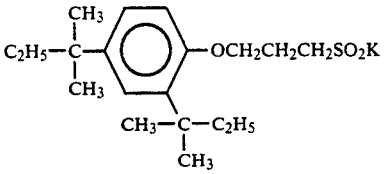
S-32
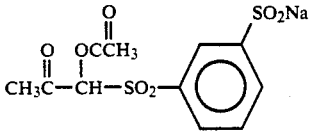
S-33
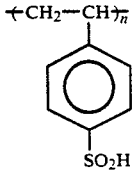
n = about 500
S-34
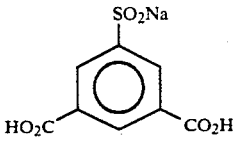
S-35
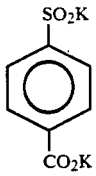
S-36
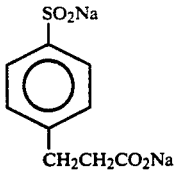
S-37
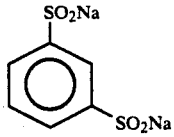
S-38
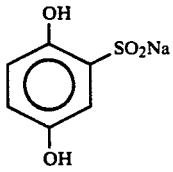
S-39

-continued

S-40

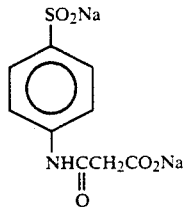

S-41

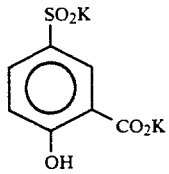

S-42

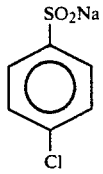

S-43

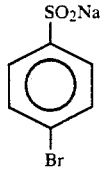

Among these compounds, particularly preferred sulfinic acids and sulfinates are S-1, S-2, S-36, S-42 and S-43.

These compounds can be used singly or in admixture.

The synthesis of the above-mentioned sulfinic acids can be accomplished by the method as disclosed in U.S. Pat. No. 4,770,987 or in accordance with such a method.

The carbonyl compound-bisulfurous acid addition product to be used in the present processing process will be further described hereinafter.

The carbonyl compound is preferably an aliphatic carbonyl compound containing 8 or less carbon atoms, and particularly preferably an aliphatic carbonyl compound containing 1 to 3 carbonyl groups.

It is well known that these carbonyl compounds can easily form adducts with bisulfurous ions or sulfurous ions. Thus, carbonyl compound-bisulfurous acid addition products can be easily obtained.

Specific examples of carbonyl compound-bisulfurous acid addition products which can be used in the present invention include the following compounds and salts thereof.

K-1: Acetaldehyde-bisulfurous acid addition product;

K-2: Propionaldehyde-bisulfurous acid addition product;

K-3: n-Butyl aldehyde-bisulfurous acid addition product;

K-4: iso-Butyl aldehyde-bisulfurous acid addition product;

K-5: Glutaraldehyde-bisulfurous acid addition product;

K-6: Aldehyde succinate-bisulfurous acid addition product;

K-7: Aldehyde malonate-bisulfurous acid addition product;

K-8: Aldehyde maleate-bisulfurous acid addition product;

K-9: 8-Methyl glutaraldehyde-bisulfurous acid addition product;

K-10: Glycol aldehyde-bisulfurous acid addition product;

K-11: Glyoxylic acid-bisulfurous acid addition product;

K-12: Pyruvic aldehyde-bisulfurous acid addition product;

K-13: D-glycerin aldehyde-bisulfurous acid addition product;

K-14: L-glycerin aldehyde bisulfurous acid addition product;

K-15: Fomic acid-bisulfurous acid addition product;

K-16: Chloroacetaldehyde-bisulfurous acid addition product;

K-17: Bromoacetaldehyde-bisulfurous acid addition product;

K-18: Acetone-bisulfurous acid addition product;

K-19: Dihydroxyacetone-bisulfurous acid addition product;

K-20: Hydroxyacetone-bisulfurous acid addition product;

K-21: Pyruvic acid-bisulfurous acid addition product;

K-22: N-acetylaminoacetic acid-bisulfurous acid addition product;

K-23: 3-Acetylpropionic acid-bisulfurous acid addition product;

K-24: 4-Acetylpropanol-bisulfurous acid addition product;

K-25: 4-Acetylbutyric acid-bisulfurous acid addition product;

K-26: Ethyl methylacetoacetate-bisulfurous acid addition product;

K-27: Ethyl acetoacetate-bisulfurous acid addition product;

K-28: Methyl ethyl ketone-bisulfurous acid addition product;

K-29: Acetylacetone-bisulfurous acid addition product;

K-30: Ethyl ethylacetoacetate-bisulfurous acid addition product;

K-31: Benzaldehyde-o-sulfonic acid-bisulfurous acid addition product;

K-32: Nicotinaldehyde-bisulfurous acid addition product.

Among these compounds, preferred carbonyl compound-bisulfurous acid addition products are K-1, K-2, K-6, K-13, K-14, K-21, K-31, and K-32. Particularly preferred among these compounds are K-13, K-21, and K-31.

These carbonyl compound-bisulfurous acid addition products may be added in a separate form, i.e., carbonyl group and bisulfurous acid or sulfurous acid or in the form of an addition product.

In the carbonyl compound-bisulfurous acid addition products to be used in the present invention, the molar ratio of the carbonyl compound to the bisulfurous acid salt or sulfurous acid salt is preferably in the range of 5/1 to 1/10, particularly 1/1 to 1/5.

The above-mentioned carbonyl compound-bisulfurous acid addition products are all commercially available and can be easily obtained.

The incorporation of the above-mentioned sulfinic acid, sulfinate or carbonyl compound-bisulfurous acid addition product into the washing solution and/or the stabilizing solution can be accomplished by various methods. Examples of these methods include: (1) directly adding the material to the washing bath and/or stabilizing bath, (2) adding the material to a prebath having a fixing ability so that it is brought into the washing bath and/or stabilizing bath together with the light-sensitive material to be processed, and (3) adding the material to the replenisher of the washing bath and/or stabilizing bath. Preferred among these methods is the method (2).

In the method (2) in the initial stage of processing, the amount of silver thiosulfate carried by the light-sensitive material into the washing bath and stabilizing bath is relatively small, causing little or no sulfide stain in the washing bath and stabilizing bath. As the processing proceeds and the amount of silver thiosulfate carried by the light-sensitive material into the washing bath and stabilizing bath increases, there gradually occurs a sulfide stain in the washing bath and stabilizing bath. However, the amount of sulfinic acid, sulfinate or carbonyl compound-bisulfurous acid addition product, which serves as preservative, carried by the light-sensitive material into the washing bath and stabilizing bath increases at the same time, inhibiting the sulfide stain in the washing bath and stabilizing bath. These compounds can also be advantageously added to a bath having a fixing ability to inhibit sulfide stain in the fixing bath itself.

The washing bath and/or stabilizing bath contains the above-mentioned sulfinic acid, sulfinate or carbonyl compound-bisulfurous acid addition product. The amount of that compound can be properly determined depending on (1) the silver content in the light-sensitive material to be processed, (2) the amount of silver thiosulfate carried from the bath having a fixing ability into the washing bath and/or stabilizing bath, and (3) which one of the tanks constituting the multistage countercurrent process washing and/or stabilizing step has a reverse osmosis membrane installed therein. In particular, the washing and/or stabilizing solution preferably contains the above-mentioned compound in an amount of at least 0.0001 mol/l.

In the present invention, the tanks constituting the washing and/or stabilizing step each preferably contains the present compound in an amount sufficient to inhibit the decomposition of silver thiosulfate. Since silver thiosulfate is carried from the prebath having a fixing ability into the washing bath and/or stabilizing bath together with the light-sensitive material, the silver thiosulfate content differs with the tanks constituting the washing and/or stabilizing step. In particular, the 1st tank in the washing and/or stabilizing step receives the largest amount of silver thiosulfate carried from the prebath. The amount of silver thiosulfate carried increases towards the last tank. Accordingly the amount of the present compound required to inhibit the decomposition of silver thiosulfate increases towards the last tank.

More particularly, if the washing and/or stabilizing processing is effected in a countercurrent process, the content of the present compound in the 1st tank is preferably in the range of 0.005 to 0.2 mol/l, more preferably 0.01 to 0.1 mol/l, most preferably 0.02 to 0.08 mol/l. The content of the present compound in the 2nd tank is preferably in the range of 0.0005 to 0.05 mol/l, more preferably 0.001 to 0.02 mol/l, most preferably 0.002 to 0.01 mol/l. The content of the present compound in the 3rd tank is preferably in the range of 0.0001 to 0.01 mol/l, more preferably 0.0005 to 0.005 mol/l.

Thus, if the method (2) is used to incorporate the present compound into a prebath having a fixing ability so that it is carried into the washing bath and/or stabilizing bath together with the light-sensitive material, the content of the present compound in the bath having a fixing ability is preferably in the range of 0.01 to 2 mol/l, more preferably 0.03 to 1 mol/l, most preferably 0.05 to 0.5 mol/l.

If the present compound is directly added to the washing bath and/or stabilizing bath (the method (1)), the tanks constituting the washing and/or stabilizing step each preferably contains the present compound in an amount required to inhibit the decomposition of silver thiosulfate as mentioned above. However, if the content of the present compound in the last tank in the washing and/or stabilizing step is too large, the light sensitive material thus finished becomes more adhesive, causing stain and deteriorating the preservability of dye images. Accordingly, if the present compound is directly added to the washing bath and/or stabilizing bath, the content of the present compound in the 1st tank in the washing and/or stabilizing step is preferably in the range of 0.005 to 0.2 mol/l, more preferably 0.01 to 0.1 mol/l.

If the present compound is added to the replenisher (the method (3)), since the replenisher is incorporated in the last tank in the processing step, it is more difficult to change the required content of the present compound from tank to tank than in the methods (1) and (2). Thus, the method (3) is a less effective method. However, in light of the diluting effect given by the introduction of water which permeates the reverse osmosis membrane, the present compound can be added to the replenisher in the amount of 0.001 to 0.02 mol/l, more preferably 0.002 to 0.01 mol/l. Alternatively, if the content of the present compound in the 1st tank is kept in the range of 0.005 to 0.2 mol/l the present compound can be added to the replenisher in an amount sufficient to make up for the deficiency so that it is carried into the prebath together with the overflow solution from the processing step.

In the present invention, it is important to inhibit the decomposition of silver thiosulfate particularly in the tank where the reverse osmosis membrane is installed, and hence where the clogging of the reverse osmosis membrane occurs. From this standpoint, the content of the present compound in the tank where the reverse osmosis membrane is installed is preferably in the range of 0.0005 to 0.05 mol/l, more preferably 0.001 to 0.02 mol/l, most preferably 0.002 to 0.01 mol/l.

In the present invention, the washing solution and/or stabilizing solution is processed through a reverse osmosis membrane. More particularly, the solution in at least one of the tanks constituting the washing and/or stabilizing step is brought into contact with the reverse osmosis membrane, and the solution which permeates through the reverse osmosis membrane is then returned into the tanks constituting the washing and/or stabilizing step.

The washing and/or stabilizing step in a multistage countercurrent process preferably 2 to 6 tanks, more preferably 3 to 5 tanks, most preferably 4 or 5 tanks. All these constituent tanks may be washing baths or stabilizing baths. Alternatively, these constituent tanks may consist of a combination of washing baths and stabilizing baths. For example, these constituent tanks may consist of a plurality of washing baths and at least one subsequent stabilizing bath.

If the washing and/or stabilizing step in a multi-stage countercurrent process comprises 3 or more tanks, the reverse osmosis membrane is preferably installed in the 2nd tank or any subsequent tank except for the last tank. In this case, the solution which permeates through the reverse osmosis membrane is preferably returned to any tank following the tank where the reverse osmosis membrane is installed, while the solution thus concentrated is preferably returned to the tank where the reverse osmosis membrane is installed.

If the washing and/or stabilizing step in a multi-stage countercurrent process consists of 2 tanks, the reverse osmosis membrane is preferably installed in the 1st tank. In this case, the solution which has been processed through the reverse osmosis membrane is returned to the 2nd tank while the solution thus concentrated is returned to the 1st tank where the reverse osmosis membrane is installed.

In the present invention, the washing and/or stabilizing step in a multi-stage countercurrent process preferably comprises 3 or more tanks, and the reverse osmosis membrane is preferably installed in the 2nd tank or any following tank. This is because the fixing or blixing solution carried into the 1st tank has a high concentration. If a reverse osmosis membrane is installed in the 1st tank, the reverse osmosis membrane needs a large area and a high pressure to allow sufficient amount of solution to permeate through the reverse osmosis membrane, and the quality of the solution which permeates through the reverse osmosis membrane is deteriorated, making it difficult to reduce the replenishment rate of fresh processing solution.

Specific examples of structures of the washing and/or stabilizing step in the present invention are as follows:

Structure (1): Three tanks, i.e., 1st washing bath, 2nd washing bath and 3rd washing bath are provided following a processing bath having a fixing ability (hereinafter fixing bath or blixing bath). In this structure, the replenisher is supplied into the 3rd washing bath. The overflow solution from each bath is introduced into the respective prebath (the overflow solution from the 1st washing bath may be introduced into its prebath, i.e., a processing bath having a fixing ability, hereinafter the same). A reverse osmosis membrane is provided in the 2nd washing bath. In other words, the washing solution in the 2nd washing bath is introduced into the reverse osmosis membrane through a pipe. The solution which has permeated through the reverse osmosis membrane is supplied into the 3rd washing bath. The solution thus concentrated is returned to the 2nd washing bath.

Structures (2) and (3): Four tanks, i.e., 1st washing bath, 2nd washing bath, 3rd washing bath and 4th washing bath are provided following a processing bath having a fixing ability. In this structure, the replenisher is supplied into the 4th washing bath. The overflow solution from each bath is introduced into the respective prebath. The reverse osmosis membrane may be installed in the 2nd washing bath [Structure (2)] or in the 3rd washing bath [Structure (3)]. In particular, if the reverse osmosis membrane is installed in the 2nd washing bath in accordance with Structure (2), the washing solution in the 2nd washing bath is introduced into the reverse osmosis membrane through a pipe. The solution which has permeated through the reverse osmosis membrane is supplied into the 3rd washing bath (or the 4th washing bath) while the solution thus concentrated is returned to the 2nd washing bath. Alternatively, if the washing solution in the 3rd washing bath is introduced into the reverse osmosis membrane through a pipe, the solution which has permeated through the reverse osmosis membrane is supplied into the 4th washing bath while the solution thus concentrated is returned to the 3rd washing bath.

Structures (4), (5) and (6): In these structures, the washing bath and washing solution in Structures (1), (2) and (3) are replaced by a stabilizing bath and stabilizing solution, respectively.

Preferred among these structures are Structures (1), (3), (4) and (6).

The supply of a processing solution (washing solution or stabilizing solution) from the tank where the reverse osmosis membrane is installed into the reverse osmosis membrane can be accomplished by supplying the overflow solution from the tank where the reverse osmosis membrane is installed into the reverse osmosis membrane or by forceably supplying the processing solution from the tank where the reverse osmosis membrane is installed through a pipe provided separately of the bath of the overflow solution. Preferably, the latter forced supply system is employed. In either case, pressure is needed to force the processing solution to permeate through the reverse osmosis membrane and then be supplied to the reverse osmosis membrane.

Examples of reverse osmosis membranes include various reverse osmosis membranes such as high pressure reverse osmosis membranes, middle pressure reverse osmosis membranes and low pressure osmosis membranes. However, a high pressure reverse osmosis membrane which needs 40 to 55 kg/cm$^2$ to operate is expensive and requires a high pressure pump which adds to the facility cost. The high pressure reverse osmosis membrane also consumes much energy. The high pressure reverse osmosis membrane is also disadvantageous in that when the processing solution (washing solution or stabilizing solution) is subjected to a high pressure, its temperature raises, adversely affecting the photographic properties. Additionally, it makes noise. Thus, it has been desired to use a low pressure reverse osmosis membrane. However, such a low pressure reverse osmosis membrane is disadvantageous in that it is very sensitive to clogging which causes a drop in the permeable amount of solution as mentioned above. Thus, the low pressure reverse osmosis membrane has never been put into prolonged and stable use. In accordance with the present invention, even when such a low pressure reverse osmosis membrane is used, clogging and the reduction in the permeable amount of solution can be inhibited, making it possible to obtain images with excellent properties constantly over an extended period of time.

Accordingly, the reverse osmosis membrane may be a high pressure reverse osmosis membrane or a middle pressure reverse osmosis membrane, preferably a low pressure reverse osmosis membrane. More particularly, a reverse osmosis membrane is preferably used which removes NaCl from an aqueous solution containing 2,000 ppm of NaCl at an efficiency of 30 to 90% when the aqueous solution is subjected to reverse osmosis therethrough at a temperature of 25° C. under a pressure of 5 kg/cm$^2$. When such a loose reverse osmosis membrane is used, a large amount of solution can permeate therethrough under a low pressure and EDTA-Fe, which causes stain, can be sufficiently removed.

These reverse osmosis membranes consist of a skin layer which controls the membrane properties such as water permeability and percentage removal efficiency and a support layer. These reverse osmosis membranes are divided into two groups, i.e., an asymmetrical membrane wherein two layers are formed of the same material and a composite membrane wherein two layers are formed of different materials. Examples of asymmetrical membranes include cellulose acetate membrane and polyamide membrane. Examples of composite membranes include synthetic composite membranes formed of synthetic materials, such as a membrane obtained by coating polyethyleneimine and tolylene diisocyanate on a polysulfone support layer so that a skin layer is formed thereon, and a membrane obtained by polymerization of furfuryl alcohol on a polysulfone support layer so that a skin layer is formed thereon. These membranes are further described in Kodobunriqijutsu no Kaihatsu, Jitsuyoka (Development and Practical Use of High Separation Technology), Kagaku Kogyosha's independent volume 29-7, pp. 156–172. In the present invention, these composite membranes are preferably used in light of their removal efficiency, water permeability and durability against EDTA-Fe.

Specific examples of such synthetic composite membranes include DRA-40, DRA-80 and DRA-89 available from Daicel., Ltd. and SU-200, SU-210 and SU-220 available from Toray Industries Inc.

In the present invention, the supply pressure of the processing solution to be supplied into the reverse osmosis membrane is preferably in the range of 2 to 20 kg/cm$^2$, more preferably 3 to 15 kg/cm$^2$, further preferably 3 to 10 kg/cm$^2$, most preferably 3 to 6 kg/cm$^2$.

In the multi-stage countercurrent process, the replenisher of fresh solution is introduced into the respective last tank of the washing bath and stabilizing bath. The replenishment rate of fresh solution is normally in the range of 800 ml or more per m$^2$ of light-sensitive material. Even if a multi-stage counter-current process and a reverse osmosis membrane are combined, the replenishment rate of fresh rate has heretofore been in the range of 400 ml/l or more per m$^2$ of light-sensitive material. In accordance with the present invention, even if the replenishment rate of fresh solution is reduced, images having excellent properties can be obtained constantly over an extended period of time.

In the present invention, since the clogging of the reverse osmosis membrane can be effectively inhibited, the permeable amount of solution can be prevented from being reduced, making it possible to return the solution which has permeated through the reverse osmosis membrane to the processing bath in a stable amount. The solution thus returned can be used as part of the fresh solution to be supplied as replenisher.

Accordingly, the replenishment rate of fresh solution may be in the range of 200 ml or less, preferably 30 to 200 ml, most preferably 50 to 150 ml per m$^2$ of light-sensitive material.

In the present invention, when the supplied amount of the solution which has permeated through the reverse osmosis membrane (the amount of solution which permeates through the reverse osmosis membrane so that it is purified, and then is supplied to any tank following the tank where the reverse osmosis membrane is installed) is represented by F, the amount of solution concentrated (the amount of solution which is concentrated through the reverse osmosis membrane, and then returned to the tank where the reverse osmosis membrane is installed) is represented by C, and the replenishment rate of fresh solution is represented by R, F is preferably not less than R, more preferably 2 to 200 times R, further preferably 5 to 150 times R, particularly 10 to 100 times R, and C is preferably not less than F, more preferably 2 to 100 times F, further preferably 3 to 50 times F, particularly 5 to 30 times F. If C falls below F, the effect of inhibiting clogging of the reverse osmosis membrane is reduced. The value of F, C and R indicates a daily flow rate. This is because the replenisher of fresh solution is intermittently supplied while reverse osmosis with respect to C and F is intermittently or continuously conducted.

The present invention will be further described with reference to FIGS. 1, 2 and 3.

Figure 2:
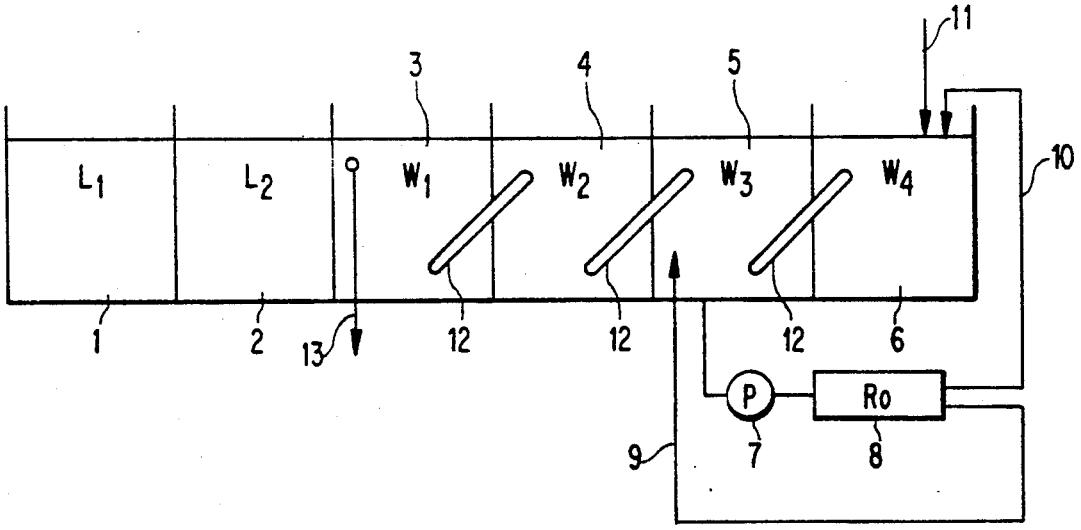
Figure 3:
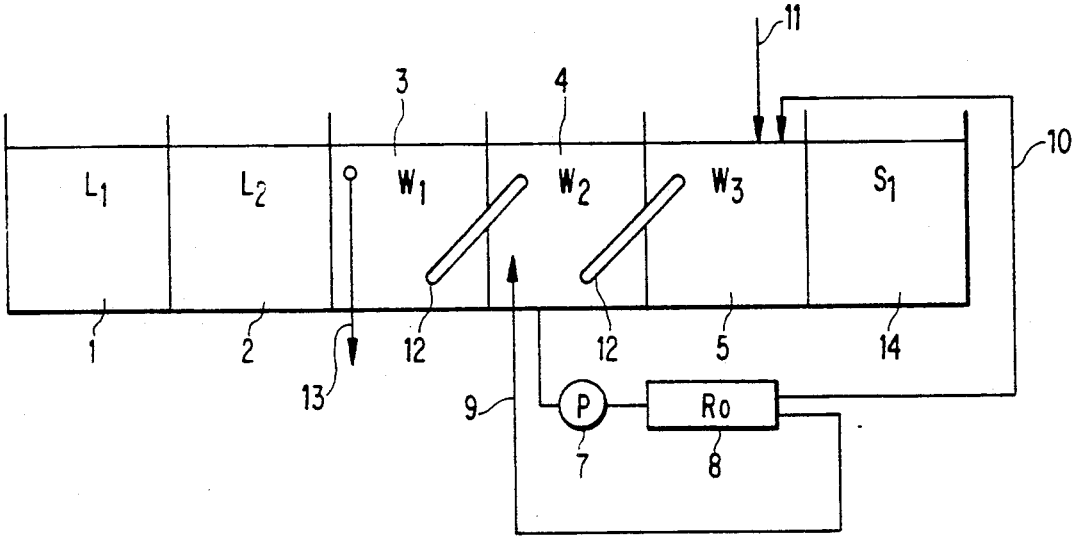

In FIGS. 1, 2 and 3, the reference numbers indicate the following parts:

1: Color developing tank $L_1$
2: Blixing tank $L_2$
3: 1st Washing Tank $W_1$
4: 2nd Washing Tank $W_2$
5: 3rd Washing Tank $W_3$
6: 4th Washing Tank $W_4$
7: Feed pump P
8: Pressure apparatus $R_0$ with built-in reverse osmosis membrane
9: Concentrated solution C
10: Water F which permeates through reverse osmosis membrane
11: Replenisher of fresh solution R
12: Pipe K for countercurrent washing
13: Overflow water OF
14: Stabilizing tank $S_1$ FIG. 1 illustrates a 3-tank countercurrent washing process in which the washing solution is taken from the 2nd washing tank $W_2$ and then subjected to reverse osmosis. The water F which has permeated through the reverse osmosis membrane is then supplied into the 3rd washing tank $W_3$ while the solution C thus concentrated is returned to the 2nd washing tank $W_2$. This process is advantageous in that it can be effected at a low cost due to simple piping. The pressure apparatus is made of metal or plastics and has a reverse osmosis membrane installed therein. As the material of such a reverse osmosis membrane, glass fiber-filled reinforced plastics can be preferably used to satisfy both corrosion resistance and pressure resistance. In this reverse osmosis process, the required amount of replenisher of fresh solution R can be drastically reduced, accordingly reducing the amount of overflow water OF from the 1st washing tank $W_1$. As a result, the overflow water OF can all be introduced into the blixing tank $L_2$.

The process shown in FIG. 1 can be also effected in a countercurrent washing process using 2 or more or 4 or more tanks and a countercurrent stabilizing process using 2 or more tanks.

FIG. 2 illustrates a 4-tank countercurrent washing process in which the washing solution is taken from the 3rd washing tank $W_3$ and then subjected to reverse osmosis. The water F which has permeated through the reverse osmosis membrane is then supplied into the 4th washing tank $W_4$ while the solution C thus concentrated is returned to the 3rd washing tank $W_3$. In this process, the washing solution having a lower silver thiosulfate concentration than that in the process of FIG. 1 is processed. As a result, the water F which has permeated through the reverse osmosis membrane can have a higher purity, making it possible to keep the washing solution in the last washing tank $W_4$ purer. Furthermore, the amount of replenisher of fresh solution R can be reduced more than in the process of FIG. 1. However, since the process of FIG. 2 has one more tank than the process of FIG. 1, it has a higher apparatus cost.

The processes of FIGS. 1 and 2 can also be effectively performed in a countercurrent washing process using 5 or more tanks or a countercurrent stabilizing process using 5 or more tanks.

FIG. 3 illustrates a similar 3-tank countercurrent washing process as shown in FIG. 1 but followed by an additional stabilizing tank $S_1$. In accordance with this process, an effect of stabilizing images which cannot be obtained by the washing process alone can be provided.

In the present invention, as the fresh solution to be supplied to the washing tank there can be used tap water, well water or the like. In order to inhibit the propagation of bacteria in the washing tank and more efficiently inhibit the clogging of the reverse osmosis membrane, water can be preferably used containing calcium and magnesium in an amount of 3 mg/l or less, respectively. In particular, water deionized with ion-exchanging resin or by distillation can be preferably used.

It is known that an antimold, chelating agent, pH buffer, fluorescent brightening agent or the like can be incorporated in the washing solution. These additives can be used if desired. In order to keep the load to the reverse osmosis membrane from increasing, it is preferred that these additives be not used in too large an amount.

If bacteria propagate in the reservoir of the fresh solution to be supplied, the reservoir is preferably irradiated with ultraviolet rays.

In the present invention, the development of the photographic light-sensitive material may be achieved either by a process for forming silver images (black-and-white development) or by a process for forming color images (color development) and preferably by a color development. Alternatively, if a reversal process is used to form images, a black-and-white negative development may be followed by exposure to white light or processing in a bath containing a fogging agent to effect color development.

The black-and-white development process normally involves development, fixing, and washing. If the development step is followed by a stop step, or the fixing step is followed by a stabilizing step, the washing step can be omitted. A developing agent or its precursor may be incorporated in the light-sensitive material so that the development may be effected with an alkaline solution alone. Alternatively, the development may be effected with a lith developer.

Examples of the color development process which can be used in the present invention include the commonly used color development processes described in *Research Disclosure* Nos. 17643 (pp. 28–29) and 18716 (right column to left column on page 615). For example, the color development process involves a color development step, a bleaching step, a fixing step, a washing step, and optionally a stabilizing step. The processing with a bleaching solution and the processing with a fixing solution can be replaced by a blixing step with a blixing solution. Alternatively, the bleaching step, the fixing step and the blixing step can be properly combined. A monobath processing with a combined developing and blixing can be used to effect color development, bleaching and fixing in one bath. These processing steps may be combined with a pre-hardening processing step, a process for neutralizing the system, a stop-fixing step, a post-hardening processing step or the like. A washing step may be interposed between these steps. In these processes, the color development step may be replaced by an activator processing step in which a light-sensitive material comprising a color developing agent or its precursor incorporated therein is developed with an activator solution. The activator processing can be effected in a monobath process.

As the black-and-white developing solution to be used in the black-and-white developing step there can be used a known developing solution for use in the development of a black-and-white photographic light-sensitive material. Such a black-and-white developing solution can contain various additives which are commonly incorporated in black-and-white developing solutions.

Typical examples of these additives include developing agents such as 1-phenyl-3-pyrazolidone, methol, and hydroquinone, preservatives such as sulfite, accelerators made of alkali such as sodium hydroxide, sodium carbonate and potassium carbonate, inorganic or organic inhibitors such as potassium bromide, 2-methylbenzimidazole and methylbenzthiazole, water softeners such as polyphosphate, and surface overdevelopment inhibitors made of a slight amount of iodide or mercapto compound.

In the present invention, the color developing solution is an alkaline aqueous solution containing as a main component an aromatic primary amine color developing agent. As such a color developing agent there can be effectively used an aminophenol compound, preferably p-phenylenediamine compound. Typical examples of such a p-phenylenediamine compound include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfate, hydrochloride and p-toluenesulfonate thereof. These compounds can be used in a combination of two or more depending on the purpose of application.

In the present invention, the color developing solution is preferably substantially free of benzyl alcohol. This means that the present color developing solution may contain benzyl alcohol in an amount of 1 ml/l or less, preferably no benzyl alcohol.

The color developing solution may comprise various preservatives. In order to compensate for the drop in the color development properties caused by the absence of benzyl alcohol, the color developing solution preferably has a small competitive reactivity with the coupling reaction of an oxidation product of a color developing agent and a coupler and a small development activity with silver halide.

From this standpoint, it is preferred that sulfite and hydroxylamine, which have heretofore been widely used, be used as sparingly as possible, preferably not at all.

Instead of these sulfites and hydroxylamines, there may be preferably used organic preservatives such as a hydroxylamine derivative (excepting for a hydroxylamine), hydroxamic acids, hydrazines, hydrazides, phenols, $\alpha$-hydroxyketones, $\alpha$-aminoketones, saccharides, monoamines, diamines, polyamines, quaternary ammonium salts, nitroxy radicals, alcohols, oxims, diamide compounds, and condensed amines.

The color developing solution preferably has a pH value of 9 to 11, more preferably 9.5 to 10.5. The color developing solution may also contain known developer components.

In order to keep the pH value in the above-mentioned range, various buffers may be preferably used. Examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of a buffer to be incorporated in the color developing solution is preferably in the range of 0.1 mol/l or more, particularly preferably 0.1 to 0.4 mol/l.

In addition, the color developing solution can comprise various chelating agents such as calcium and magnesium precipitation inhibitors to improve the stability thereof.

Specific examples of such chelating agents include nitrilotriacetic acid, diethylenetriaminepentaacetic acid, ethylenediaminetetraacetic acid, triethylenetetraminehexaacetic acid, N,N,N-trimethylene-phosphonic acid, ethylenediamine-N,N,N',N'-tetramethylenephosphonic acid, 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycoletherdiaminetetraacetic acid, hydroxyethylenediaminetriacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl) ethylenediamine-N,N'-diacetic acid. However, the present invention should not be construed as being limited to these agents.

These chelating agents can be optionally used in a combination of two or more.

The amount of a chelating agent to be incorporated into the color developing solution may be such that metallic ions therein can be blocked. For example, the content of such a chelating agent maybe in the range of 0.1 to 10 g per l of color developing solution.

Furthermore, the color developing solution may optionally contains any development accelerator.

Examples of such a development accelerator include thioether compounds disclosed in JP-B-37-16088, JP-B-37-5987, JP-B-38-7826, JP-B-44-12380, and JP-B-45-9019 (the term "JP-B" as used herein means an "examined Japanese patent publication"), and U.S. Pat. No. 3,813,247; p-phenylenediamine compounds disclosed in JP-A-62-49829 and JP-A-50-15554; quaternary ammonium salts as disclosed in JP-A-50-137726, JP-B-44-30074, JP-A-56-156826 and JP-A-52-43429; p-aminophenols disclosed in U.S. Pat. Nos. 2,610,122 and 4,119,462; amine compounds disclosed in U.S. Pat. Nos. 2,494,903, 3,128,182, 4,230,796, 3,253,919, 2,482,546, 2,596,926, and 3,582,346, and JP-B-41-11431; polyalkylene oxides disclosed in JP-B-37-16088, JP-B-42-25201, JP-B 37-41-11431, and JP-B-42-23883, and U.S. Pat. Nos. 3,128,183, and 3,532,501; 1-phenyl-3-pyrazolidones; hydrazines; isoionic compounds; ionic compounds; and imidazoles.

The color developing solution may optionally comprise any fog inhibitor. That fog inhibitor may be a halide of alkaline metal such as potassium bromide and potassium iodide or an organic fog inhibitor. Typical examples of such an organic fog inhibitor include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

The color developing solution preferably comprises a fluorescent brightening agent. That fluorescent brightening agent is preferably 4,4'-diamino-2,2'-disulfostilbene compound. The amount of such a fluorescent brightening agent to be incorporated is in the range of generally 0 to 5 g/l, preferably 0.1 to 4 g/l.

The color developing solution may also optionally comprise various surface active agents such as alkylsulfonic acid, arylsulfonic acid, alkyl-phosphonic acid, arylphosphonic acid, aliphatic carboxylic acid and aromatic carboxylic acid.

The processing temperature of the color developing solution is in the range of generally 20° to 50° C., preferably 30° to 40° C. The color development time is in the range of generally 20 seconds to 5 minutes, preferably 30 seconds to 2 minutes.

Examples of the bleaching agents to be incorporated into the bleaching solution or blixing solution include compounds of polyvalent metals such as iron(III), cobalt(III), chromium(IV) and copper(II), peroxides, quinones, and nitro compounds. Typical examples of bleaching agents include ferricyanides; bichromates; organic complex salts of iron(III) or cobalt(III) such as complex salts of such a metal with aminopolycarboxylic acid (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid), citric acid, tartaric acid, or malic acid; persulfates; bromates; permanganates; and nitrobenzenes. Preferred among these bleaching agents are the above-mentioned organic acid ferric complex salts.

The amount of the bleaching agent to be incorporated into the bleaching or blixing solution is preferably in the range of 0.05 to 0.5 mol/l, particularly preferably 0.1 to 0.3 mol/l in light of its desilvering properties, cyan dye recoverability and stain inhibition. If such an organic acid ferric complex salt is used, a free organic acid is normally incorporated in a molar ratio of 1/10.

As the thiosulfate to be incorporated into the processing solution having a fixing ability there can be used a known thiosulfate such as ammonium thiosulfate and sodium thiosulfate. As the preservative to be incorporated in the processing solution having a fixing ability there can be used a sulfite such as sodium sulfite and ammonium sulfite.

The bleaching solution and blixing solution may contain known additives such as a rehalogenating agent (e.g., ammonium bromide, ammonium chloride), pH buffer (e.g., ammonium nitrate), a. metal corrosion inhibitor (e.g., ammonium sulfate), a fluorescent brightening agent, an anti-foaming agent, a surface active agent, a polyvinyl pyrrolidone, and methanol.

The fixing solution may preferably contain aminopolycarboxylic acids or organic phosphonic acid chelating agents (preferably 1-hydroxyethylidene-1,3-diphosphonic acid, N,N,N',N'-ethylenediaminetetraphosphonic acid) in order to improve the stability thereof.

The pH value of the blixing solution is predetermined in the range of generally 3 to 8, preferably 4.5 to 7.5, particularly preferably 5.5 to 6.5 in light of its desilvering properties, improvement in color recoverability and stain inhibition. The pH value of the bleaching solution is predetermined in the range of generally 2.5 to 6.5, preferably 2.5 to 4.0. The blixing and bleaching are effected at a temperature of 25° to 45° C., preferably 30° to 40° C., particularly 33° to 38° C. to maintain the rapidity of processing and preservability of the solution.

In the present processing method, a silver halide light-sensitive material is processed in a bath containing a thiosulfate and having a fixing ability, and then subjected to washing and/or stabilization in a multi-stage countercurrent process. It goes without saying that the blixing or fixing solution has heretofore contained a preservative for the silver thiosulfate. As such a preservative, a sulfite is most common.

The inventors found that while the sulfite serves as a highly effective preservative in a blixing or fixing solution, it does not work effectively in a washing solution or a stabilizing solution, causing the decomposition of silver thiosulfate into silver sulfate which causes the clogging of a reverse osmosis membrane. The inventors also found that when the washing solution or stabilizing solution contains the present compound, the clogging of the reverse osmosis membrane can be effectively inhibited. In particular, when the replenishment rate of the washing solution or stabilizing solution is drastically reduced to 200 ml or less per $m^2$ of the light-sensitive material, the frequency of exchange of the washing solution or stabilizing solution is reduced, increasing the retention time of silver thiosulfate in the washing bath or stabilizing bath and thus causing more clogging in the reverse osmosis membrane. However, these problems can be eliminated by incorporating the present compound in the washing solution or stabilizing solution. As a result, the clogging in the reverse osmosis membrane and the reduction in the permeable amount of solution can be effectively inhibited, preventing yellow stain shortly after processing and after storage. Thus, images can be constantly obtained with excellent photographic properties even after a prolonged processing.

Examples of the photographic light-sensitive material processed according to the present invention include ordinary black-and-white silver halide photographic materials (e.g., black-and-white light-sensitive material for photographing, X-ray black-and-white light-sensitive material, printing black-and-white light-sensitive material), ordinary multi-layer color light-sensitive materials (e.g., color negative film, color reversal film, color positive film, color negative film for motion picture, color paper, reversal color paper, direct positive color paper), light-sensitive materials. Preferred among these light-sensitive materials are light-sensitive materials for color paper.

The type and preparation method of silver halide to be incorporated in the silver halide emulsion layer and surface protective layer in the photographic light-sensitive material according to the present invention and binders, chemical sensitizing processes, fog inhibitors, stabilizers, film hardeners, antistatic agents, couplers, plasticizers, lubricants, coating aids, matting agents, brightening agents, spectral sensitizers, dyes, ultraviolet absorbers, and supports for the photographic materials are not specifically limited. In this respect, reference can be made to Product Licensing, vol. 92, pp. 107–110, and *Research Disclosure*, vol. 176, pp. 22–31 (December, 1978), and vol. 238, pp. 44–46 (1984).

The photographic emulsion layer or other hydrophilic colloidal layers in the photographic light-sensitive material to be used in the present invention may comprise various surface active agents for various purposes, for example, as coating aids, as antistatic agents for improvement of sliding properties, as emulsification and dispersing aids, for prevention of adhesion, for improvement of photographic properties (e.g., acceleration of development, increase in contrast, and increase in sensitivity).

The silver halide emulsion to be incorporated into the photographic light-sensitive material in the present invention may be any halogen composition such as silver bromoiodide, silver bromide, silver bromochloride and silver chloride. In order to reduce the replenishment rate of the color developing solution, the halogen released from the light-sensitive material during development preferably has the small effect of inhibiting development. In this respect, the light-sensitive material to be used in the present invention preferably comprises at least one layer made of a high silver chloride content emulsion containing silver chloride in an amount of generally 80 mol % or more, more preferably 95 mol % or more, particularly preferably 98 mol % or more. In particular, each light-sensitive emulsion layer preferably comprises a high silver chloride content emulsion.

In addition, as the silver halide emulsion to be incorporated in the photographic light-sensitive material in the present invention there can also be used those described in JP-A 63-85627 (line 10 on the right top column of page 12 to line 6 on the left bottom column of page 13).

As sensitizing dyes, coupler discoloration inhibitors, ultraviolet absorbents, filter dyes, anti-irradiation dyes, brightening agents and gelatin to be incorporated in the present photographic light-sensitive material there can be used those described in JP-A-63-85627 (line 7 on left bottom column of page 13 to line 4 on right bottom column of page 24).

The present invention will be further described in the following examples, but the present invention should not be construed as being limited thereto.

EXAMPLE 1

A multi-layer color photographic paper was prepared by coating layers having the following compositions on a paper support laminated with polyethylene on both sides thereof. The coating solution for each layer was prepared by mixing and dissolving emulsion dispersions of emulsions, various chemicals and couplers. The method of preparation of each coating solution will be described hereinafter.

Preparation of Coupler Emulsion 19.1 g of a yellow coupler (ExY) and 4.4 g of a dye stabilizer (Cpd-1) were dissolved in 27.2 ml of ethyl acetate and 7.7 ml of a solvent (Solv-1). The solution thus obtained was then emulsion-dispersed in 185 ml of a 10% aqueous solution of gelatin containing 8 ml of 10% sodium dodecylbenzenesulfonate.

Emulsions for magenta, cyan and interlayer were similarly prepared. The compounds incorporated into each emulsion are set forth below:

Yellow coupler (ExY)

-continued
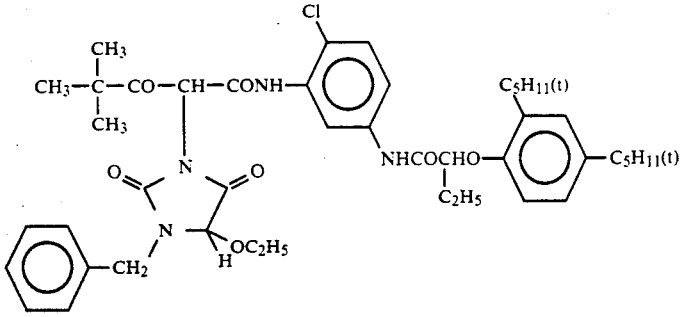
Magenta coupler (ExM1)
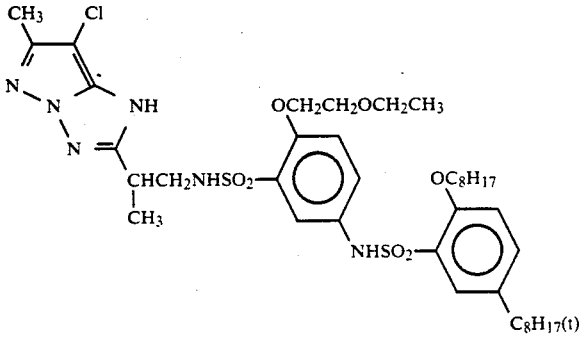
Cyan coupler (ExC1)
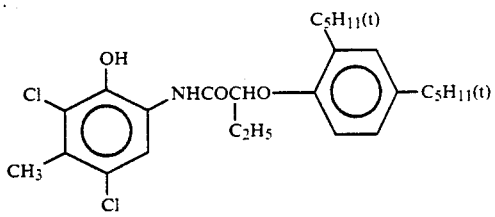
Cyan coupler (ExC2)
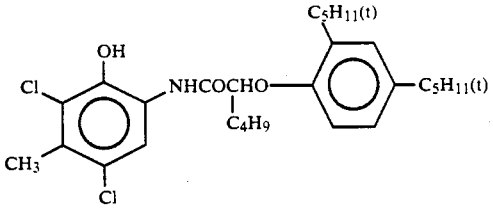
Cyan coupler (ExC3)
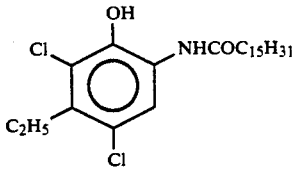
Dye stabilizer (Cpd-1)
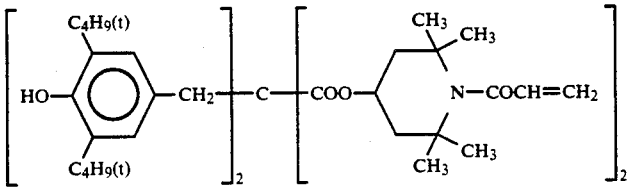

-continued

Color strain inhibitor (Cpd-2)

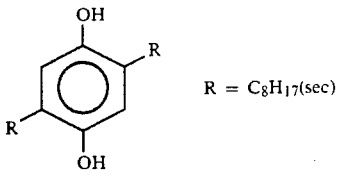

Dye stabilizer (Cpd-3)

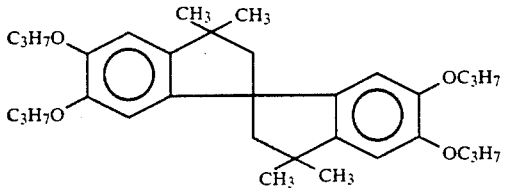

Dye stabilizer (Cpd-4)

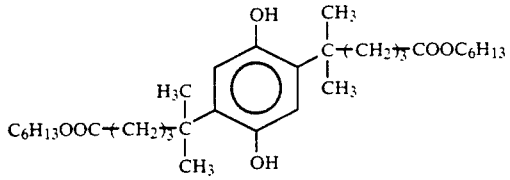

Color stain inhibitor (Cpd-5)

Same as Cpd-2 wherein R is $C_8H_{17}$(t)

Dye stabilizer (Cpd-6)

5:8:9 mixture (by weight) of Cpd-6a, Cpd-6b and Cpd-6c:

Cpd-6a

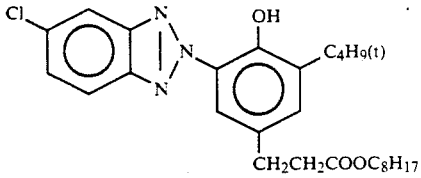

Cpd-6b

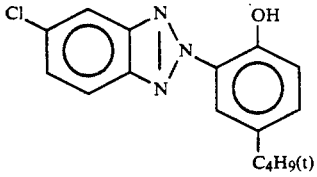

Cpd-6c

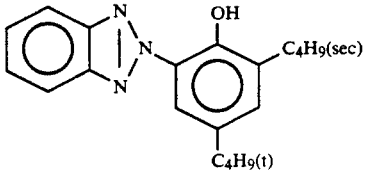

Polymer (Cpd-7)

-continued

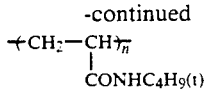

(Mean molecular weight: 80,000)

Ultraviolet absorbent (UV-1)

2:9:8 mixture (by weight) of Cpd-6a, Cpd-6b and Cpd-6c.

Solvent (Solv-1)

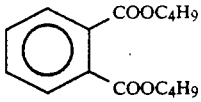

Solvent (Solv-2)

$O{=}P(O{-}C_8H_{17}(iso))_3$

Solvent (Solv-3)

$O{=}P(O{-}C_9H_{19}(iso))_3$

Solvent (Solv-4)

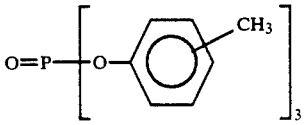

In order to inhibit irradiation, the following dyes were incorporated into the emulsion layers:

Dye-R

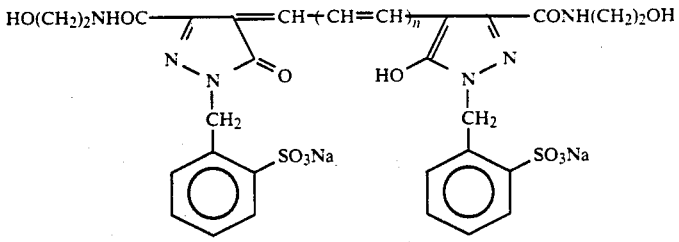

Green-sensitive layer: Dye-R wherein n = 1.

The compound of the following general formula was incorporated into the red-sensitive emulsion layer in the amount of $2.6\times10^{-3}$ per mol of silver halide:

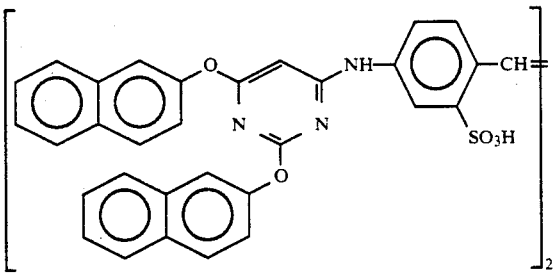

The emulsions to be used in this example will be described hereinafter.

Blue-sensitive emulsion:

A monodisperse emulsion of cubic silver chloride grains having a mean grain size of 1.1 μm and a grain size fluctuation coefficient (determined by dividing the standard deviation by the mean grain size(s/d)) of 0.10 (containing $K_2IrCl_6$ and 1,3-dimethylimidazoline-2-thione) was prepared in an ordinary manner. Twenty-six ml of a 0.6% solution of a spectral sensitizing dye for blue light (S-1) was added to 1.0 kg of the emulsion thus obtained. An emulsion of finely divided silver bromide grains having a mean grain size of 0.05 μm was added to a host silver chloride emulsion in a proportion of 0.5 mol %. The emulsion was then subjected to ripening. The emulsion was then subjected to optimum chemical sensitization with sodium thiosulfate. A stabilizer (Stb-1) was then added to the emulsion in the amount of $1\times10^{-4}$ mol/mol Ag to prepare the desired blue-sensitive emulsion.

Green-sensitive emulsion:

An emulsion of silver chloride grains containing $K_2IrCl_6$ and 1,3-dimethylimidazoline-2-thione was prepared in an ordinary manner. The emulsion was then subjected to ripening with $4\times10^{-4}$ mol/mol Ag of a sensitizing dye (S-2) and KBr. The emulsion was then subjected to optimum chemical sensitization with sodium thiosulfate. A stabilizer (Stb-1) was then added to the emulsion in the amount of $5\times10^{-4}$ mol/mol Ag to prepare a monodisperse emulsion of cubic silver chloride grains having a mean grain size of 0.48 μm and a grain size fluctuation coefficient of 0.10 to prepare the desired green-sensitive emulsion.

Red-sensitive emulsion:

A red-sensitive emulsion was prepared in the same manner as the green-sensitive emulsion except that a sensitizing dye (S-3) was used, instead of the sensitizing dye (S-2), in the amount of $1.5\times10^{-4}$ mol/mol Ag.

The sensitizing dyes and the stabilizer used are set forth below.

Sensitizing dye (S-1)

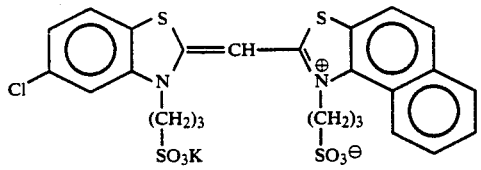

Sensitizing dye (S-2)

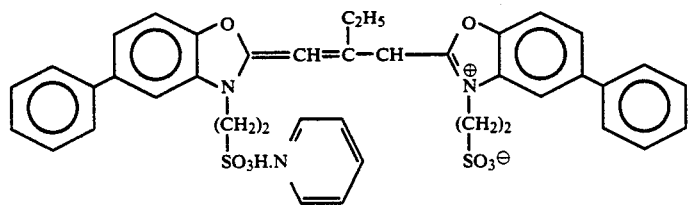

Sensitizing dye (S-3)

-continued

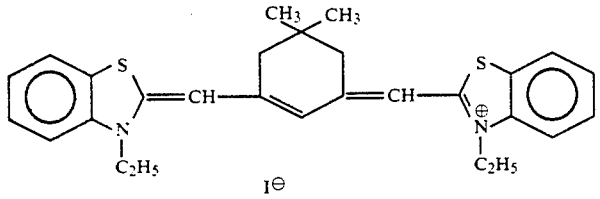

Stabilizer (Stb-1)

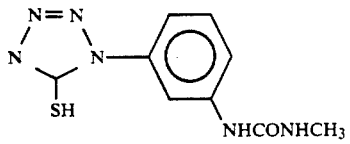

Layer Structure

The composition of each layer in the specimen is set forth below in the unit of g/m$^2$. The content of silver halide emulsion is represented in terms of the amount of silver.

Support

Polyethylene-laminated paper [containing a white pigment ($TiO_3$) and a bluing dye (ultramarine) in the polyethylene layer on the side to be coated with the 1st layer]

| | |
|---|---|
| 1st Layer: Blue-sensitive Emulsion Layer | |
| Silver halide emulsion | 0.30 |
| Gelatin | 1.86 |
| Yellow coupler (ExY) | 0.82 |
| Dye stabilizer (Cpd-1) | 0.19 |
| Solvent (Solv-1) | 0.35 |
| 2nd Layer: Color Stain Inhibiting Layer | |
| Gelatin | 0.99 |
| Color stain inhibitor (Cpd 2) | 0.08 |
| 3rd Layer: Green-sensitive Emulsion Layer | |
| Silver halide emulsion | 0.36 |
| Gelatin | 1.24 |
| Magenta coupler (ExM-1) | 0.31 |
| Dye stabilizer (Cpd-3) | 0.25 |
| Dye stabilizer (Cpd-4) | 0.12 |
| Solvent (Solv-2) | 0.42 |
| 4th Layer: Ultraviolet Absorbing Layer | |
| Gelatin | 1.58 |
| Ultramarine absorbent (UV-1) | 0.62 |
| Color stain inhibitor (Cpd-5) | 0.05 |
| Solvent (Solv-3) | 0.24 |
| 5th Layer: Red-sensitive Emulsion Layer | |
| Silver halide emulsion | 0.23 |
| Gelatin | 1.34 |
| Cyan coupler (1:2:2 mixture (molar ratio) of ExC-1, ExC-2 and ExC-3) | 0.34 |
| Dye stabilizer (Cpd-6) | 0.17 |
| Polymer (Cpd-7) | 0.40 |
| Solvent (Solv-4) | 0.23 |
| 6th Layer: Ultraviolet Absorbing Layer | |
| Gelatin | 0.53 |
| Ultraviolet absorbent (UV-1) | 0.21 |
| Solvent (Solv-3) | 0.08 |
| 7th Layer: Protective Layer | |
| Gelatin | 1.33 |
| Acryl-modified copolymer of polyvinyl alcohol (modification degree: 17%) | 0.17 |
| Liquid paraffin | 0.03 |

As the hardener for each layer, sodium salt of 1-oxy-3,5-dichloro-s-triazine was used.

The color photographic paper thus prepared was then cut into a 82.5-mm wide specimen. The color photographic paper specimen was then subjected to standard exposure in an automatic printer. The specimen thus exposed was then subjected to running processing with the following processing solutions in the following processing steps:

TABLE 1

| Step | Temp. | Processing Step: Time | Processing Step: Tank Volume | Replenishment Rate (per m$^2$ of Color Photographic Paper |
|---|---|---|---|---|
| Color development | 35° C. | 45 sec. | 10 l | 100 ml |
| Blixing | 35° C. | 45 sec. | 10 l | 60 ml |
| Washing (1) | 35° C. | 30 sec. | 4 l | |
| Washing (2) | 35° C. | 30 sec. | 4 l | |
| Washing (3) | 35° C. | 30 sec. | 4 l | (set forth in Table 2) |
| Drying | 75° C. | 50 sec. | — | — |

The washing step was effected in a 3-stage countercurrent process in which the washing solution flew backward.

| | Mother liquor | Replenisher |
|---|---|---|
| Color Developing Solution | | |
| Water | 800 ml | 800 ml |
| Ethylenediamine-N,N,N',N'-tetramethylenephosphonic acid | 3.0 g | 4.0 g |
| N,N-diethylhydroxylamine | 5.0 g | 8.0 g |
| Sodium chloride | 3.0 g | — |
| Potassium carbonate | 25 g | 29 g |
| N-ethyl-N-(β-methanesulfonamidoethyl)-3-methyl-4-aminoaniline sulfate | 5.0 g | 12 g |
| Triethanolamine | 8.0 g | 14 g |
| Fluorescent brightening agent (4,4'-diaminostilbene series) (pure content) | 1.0 g | 3.0 g |
| pH (with potassium hydroxide) | 10.05 | 10.60 |
| Water to make | 1,000 ml | 1,000 ml |
| Blixing Solution | | |
| Water | 700 ml | 700 ml |
| Ammonium thiosulfate solution (700 g/l) | 100 ml | 150 ml |
| Ammonium sulfite | 18 g | 30 g |
| Ferric ammonium ethylenediaminetetraacetate (dihydrate) | 55 g | 80 g |
| Disodium ethylenediamine- | 3 g | 5 g |

-continued

| | Mother liquor | Replenisher |
|---|---|---|
| tetraacetate (dihydrate) | | |
| Ammonium bromide | 40 g | 60 g |
| Glacial acetic acid | 8 g | 16 g |
| Compound added (set forth in Table 2) | 0.2 mol | 0.25 mol |
| Water to make | 1.000 ml | 1,000 ml |
| pH (25° C.) | 5.5 | 4.3 |

Washing solution: Commonly used as mother liquor and replenisher.

Tap water (calcium: 23 mg/l; magnesium 3 mg/l; electrical conductivity: 170 μs/cm)

The reverse osmosis membrane was a Spiral Type RO Module Element DRA-80, SW-03 (manufactured from Daicel Ltd.; effective membrane area: 1.1 $m^2$; polysulfine synthetic composite membrane). This reverse osmosis membrane was mounted in a plastic pressure vessel PV-0321 (manufactured from Daicel Ltd.).

The reverse osmosis membrane was installed in the manner shown in FIG. 1. The water in the 2nd washing tank was pumped into the reverse osmosis membrane by means of a magnet gear pump at a supply pressure of 3.5 $kg/cm^2$ and a flow rate of 1.2 l/min. The water which had permeated through the reverse osmosis membrane was then supplied into the 3rd washing tank while the solution thus concentrated was returned to the 2nd washing tank.

The running processing No. 1 to No. 7 were conducted. In each running processing, the replenishment rate of the washing solution was altered, and the presence or absence of the reverse osmosis membrane at the washing step and the presence or absence of the present compound in the blixing solution were combined. Thus, (1) the effect of inhibiting yellow stain shortly after processing and after storage, which is one of the objects of the present invention, (2) the change in the amount of water which permeates through the reverse osmosis membrane between the beginning of running processing and the end of running processing, and (3) the solution stain due to the propagation of bacteria in the washing tank or the like (which attaches and stains a light-sensitive material) were examined. The change in yellow stain was determined by measuring the reflective density at unexposed portions by mean of X-Light 310 Type Photographic Densitometer.

In each running processing, the color photographic paper was processed at a rate of 8 $m^2$ a day over 20 days.

The results of these running processing steps are set forth in Table 3.

[Evaluation of Properties]

Change in Yellow Stain Shortly after Processing

The change in yellow reflective density at unexposed portions of the processed color photographic paper between the beginning of each running processing and the end of each running processing (20 days) was measured.

(Density difference=density at the end of running processing—density at the beginning of running processing)

Change in Yellow Stain after Storage

The color photographic paper which had been subjected to running processing was then allowed to stand at a temperature of 80° C. and a relative humidity of 70% over 5 days. The difference in yellow reflective density between the time before and after storage was determined.

(Density difference=density after 5 days storage—density before storage)

Amount of Water Permeation

The amount of water permeation was determined 1 day* after the beginning of each running processing and at the end of the running processing. In the measurement, the water was received by a graduated cylinder over 1 minute.

A brand new reverse osmosis membrane shows a remarkable fluctuation in the amount of water permeation in the initial stage of use. Therefore, the amount of water permeation in the initial stage of use was measured 1 day after the beginning of use, i.e., period during which the amount of water permeation is stable.

TABLE 2

| Running Conditions | | | | |
|---|---|---|---|---|
| No. | Replenishment Rate of Washing solution ($ml/m^2$) | Reverse Osmosis | Additive to Blixing Solution | Remarks |
| 1 | 360 | None | None | Comp. Ex. |
| 2 | 180 | " | " | " |
| 3 | 180 | Yes | " | " |
| 4 | 180 | " | S-1 | Invention |
| 5 | 180 | " | S-2 | " |
| 6 | 180 | " | S-42 | " |
| 7 | 180 | " | K-21 | " |

TABLE 3

| Results of Test | | | | | |
|---|---|---|---|---|---|
| | Yellow Stain Change | | Amount of Water Permeation | | |
| No. | Shortly after Processing | After 5 Day Processing | After 1 Day (ml/min) | After 20 Days (ml/min) | Stain in Washing Solution* |
| 1 | 0.03 | 0.08 | — | — | Fair |
| 2 | 0.05 | 0.14 | — | — | Poor |
| 3 | 0.05 | 0.13 | 190 | 30 | Poor |
| 4 | 0.01 | 0.06 | 190 | 170 | Excellent |
| 5 | 0.01 | 0.07 | 180 | 150 | Excellent |
| 6 | 0.01 | 0.08 | 180 | 140 | Excelent |
| 7 | 0.01 | 0.07 | 185 | 165 | Excellent |

*Stain in washing solution
Excellent: clean
Fair: slightly stained
Poor: Much stained, suspended matters observed

EXAMPLE 2

In this example, the same photographic paper specimen, processing solutions and reverse osmosis membrane as in Example 1 were used. The washing step was effected and the reverse osmosis membrane was installed as shown in FIG. 2. The processing solution was supplied into the reverse osmosis membrane at a supply pressure of 4 $kg/cm^2$ and a flow rate of 2 l/min.

The running conditions were altered as shown in Table 4. The results of the tests are set forth in Table 5

TABLE 4

| Running Conditions | | | | |
|---|---|---|---|---|
| No. | Replenishment Rate of Washing solution ($ml/m^2$) | Reverse Osmosis | Additive to Blixing Solution | Remarks |
| 21 | 100 | None | None | Comp. Ex. |
| 22 | 100 | Yes | " | " |
| 23 | 100 | " | S-1* | Invention |
| 24 | 100 | " | S-2* | " |

TABLE 4-continued

| Running Conditions | | | | |
|---|---|---|---|---|
| No. | Replenishment Rate of Washing solution (ml/m²) | Reverse Osmosis | Additive to Blixing Solution | Remarks |
| 25 | 100 | " | K-13* | " |
| 26 | 100 | " | K-31* | " |
| 27 | 100 | " | K-32* | " |

*Added amount: 0.3 mol/l

TABLE 5

| Results of Test | | | | | |
|---|---|---|---|---|---|
| | Yellow Stain Change | | Amount of Water Permeation | | |
| No. | Shortly after Processing | After 5 Day Processing | After 1 Day (ml/min) | After 20 Days (ml/min) | Stain in Washing Solution* |
| 21 | 0.05 | 0.11 | — | — | Poor |
| 22 | 0.05 | 0.11 | 240 | 25 | Poor |
| 23 | 0.02 | 0.05 | 235 | 220 | Excellent |
| 24 | 0.02 | 0.05 | 240 | 220 | Excellent |
| 25 | 0.03 | 0.06 | 230 | 210 | Excellent |
| 26 | 0.02 | 0.06 | 230 | 190 | Excellent |
| 27 | 0.03 | 0.06 | 235 | 185 | Fair |

*Same as in Table 3

EXAMPLE 3

In this example, the same color photographic paper and reverse osmosis membrane as in Example 2 were used. The reverse osmosis membrane was installed as shown in FIG. 2. The washing step was changed to a stabilizing step, and additives were added to the stabilizing solution instead of the blixing solution.

The stabilizing solution and its replenisher used are as follows:

| Stabilizing Solution: Commonly used for mother liquor and replenisher | |
|---|---|
| 1-Hydroxyethylidene-1,1-diphosphonic acid (60 wt %) | 1.5 ml/l |
| 5-Chloro-2-methyl-4-isothiazoline-3-one | 30 mg/l |
| Fluorescent brightening agent (4,4'-diaminostilbene series) | 0.5 g/l |
| Compound added (as set forth in Table 6) | 0.02 mol/l |

The running conditions were altered as shown in Table 6. The results of the tests are set forth in Table 7.

TABLE 6

| Running Conditions | | | | |
|---|---|---|---|---|
| No. | Replenishment Rate of Stabilizing solution (ml/m²) | Reverse Osmosis | Additive to Stabilizing Solution | Remarks |
| 31 | 120 | None | None | Comp. Ex. |
| 32 | 120 | Yes | " | " |
| 33 | 120 | " | S-1* | Invention |
| 34 | 120 | " | S-43* | " |
| 35 | 120 | " | K-1* | " |
| 36 | 120 | " | K-6* | " |
| 37 | 120 | " | K-14* | " |

*Added amount: 0.2 mol/l

TABLE 7

| Results of Test | | | | | |
|---|---|---|---|---|---|
| | Yellow Stain Change | | Amount of Water Permeation | | |
| No. | Shortly after Processing | After 3 Day** Processing | After 1 Day (ml/min) | After 20 Days (ml/min) | Stain in Stabilizing Solution* |
| 31 | 0.04 | 0.08 | — | — | Poor |
| 32 | 0.04 | 0.08 | 190 | 18 | Poor |
| 33 | 0.02 | 0.03 | 185 | 170 | Excellent |
| 34 | 0.02 | 0.03 | 180 | 170 | Excellent |
| 35 | 0.03 | 0.04 | 185 | 160 | Excellent |
| 36 | 0.03 | 0.04 | 175 | 165 | Excellent |
| 37 | 0.03 | 0.05 | 180 | 155 | Fair |

*Same as in Table 3

**The specimen was allowed to stand at a temperature of 80° C. and a relative humidity of 70% over 3 days. The difference in yellow reflective density between before and after storage was determined.

EXAMPLE 4

As silver halide color negative light-sensitive materials, the Fuji Color Super HRII-100 (size: 135 mm; 24 frames) and Fuji Color Reala (size: 135 mm; 24 frames) were used. A camera was used to imagewise expose color negative light-sensitive materials to light. These color negative light-sensitive materials were then processed. In particular, the color negative films thus exposed were subjected to running processing with the following processing solutions in the following processing steps.

TABLE 8

| Processing Step | | | | |
|---|---|---|---|---|
| Step | Time | Temp. | Replenishment Rate | Tank Volume |
| Color development | 3 min. 15 sec. | 38° C. | 300 ml | 3 l |
| Bleaching | 45 sec. | 38° C. | 130 ml | 4 l |
| Fixing | 1 min. 30 sec. | 38° C. | 500 ml | 6 l |
| Washing (1) | 20 sec. | 38° C. | Countercurrent process in which water flows backward | 4 l |
| Washing (2) | 20 sec. | 38° C. | | 4 l |
| Washing (3) | 20 sec. | 38° C. | 200 ml | 4 l |
| Stabilizing | 20 sec. | 38° C. | 200 ml | 4 l |
| Drying | 1 min. 00 sec. | 55° C. | — | — |

In the above table, the replenishment rate is represented per m² of light-sensitive material.

The composition of the processing solutions are as follows:

| | Mother liquor | Replenisher |
|---|---|---|
| Color Developing Solution | | |
| Diethylenetriaminepentaacetic acid | 1.0 g | 1.5 g |
| 1-Hydroxyethylidene-1,1 diphosphonic acid | 3.0 g | 3.2 g |
| Sodium sulfite | 4.0 g | 6.0 g |
| Potassium carbonate | 38.0 g | 40.0 g |
| Potassium bromide | 1.4 g | — |
| Potassium iodide | 1.5 mg | — |
| Hydroxylamine sulfate | 2.4 g | 3.6 g |
| 4-(N-ethyl-N-β-hydroxyethylamino)- | 4.5 g | 7.8 g |

-continued

| | Mother liquor | Replenisher |
|---|---|---|
| 2-methylaniline sulfate | | |
| Water to make | 1.0 l | 1.0 l |
| pH | 10.05 | 10.20 |
| Bleaching Solution | | |
| Ferric ammonium 1,3-diaminopropanetetraacetate monohydrate | 140.0 g | 180.0 g |
| 1,3-Diaminopropanetetraacetic acid | 10.0 g | 11.0 g |
| Ammonium bromide | 140.0 g | 180.0 g |
| Ammonium nitrate | 30.0 g | 40.0 g |
| Acetic acid (98 wt %) | 25.0 ml | 30.0 ml |
| Water to make | 1.0 l | 1.0 l |
| pH | 4.5 | 3.5 |
| Fixing Solution | | |
| 1-Hydroxyethylidene-1,1-diphosphonic acid | 1.0 g | 1.5 g |
| Ammonium sulfite | 12.0 g | 20.0 g |
| Aqueous solution of ammonium thiosulfate (700 g/l) | 320 ml | 360 ml |
| Compound added (as set forth in Table 9) | 0.30 mol | 0.33 mol |
| Water to make | 1.0 l | 1.0 l |
| pH | 6.7 | 6.4 |

Washing solution: Commonly used as mother liquor and replenisher.

Both the running solution and the replenisher were prepared by passing tap water through a mixed bed column packed with an H type strongly acidic cation exchange resin ("Amberlite IR-120B", produced by Rhom & Haas Co.) and an OH type anion exchange resin ("Amberlite IR-400", produced by the same company) to reduce calcium and magnesium ion concentrations each to 3 mg/l or less, and then adding to the resulting water 20 mg/l of sodium dichloroisocyanurate and 1.5 mg/l of sodium sulfate. The pH of the resulting solution was in the range of from 6.5 to 7.5.

| Stabilizing Solution | Mother liquor | Replenisher |
|---|---|---|
| Triethanolamine | 2.0 g | 3.0 g |
| Formalin (37 wt %) | 2.0 ml | 3.0 ml |
| Polyoxyethylene-p-monomonylphenylether (average polymerization degree: 10) | 0.3 | 0.45 |
| Disodium ethylenediaminetetraacetate | 0.05 | 0.08 |
| Water to make | 1.0 l | 1.0 l |
| pH | 5.0–8.0 | 5.0–8.0 |

As the reverse osmosis membrane, the same reverse osmosis as in Example 1 was used. The reverse osmosis membrane was installed as shown in FIG. 3. The blixing tank $L_2$ in FIG. 3 consists of a bleaching tank and a fixing tank. The processing solution was supplied into the reverse osmosis membrane at a supply pressure of 4 kg/cm$^2$ and a flow rate of 2 l/min.

The running processing Nos. 41 to 46 were effected. In each running, (1) the effect of inhibiting magenta stain shortly after processing and after 7-day storage, (2) the change in the amount of water permeation through the reverse osmosis membrane between the beginning of running processing and the end of the running processing, and (3) stain on the color negative films, were examined.

For the evaluation of magenta stain, the transmission density on the unexposed portions was measured by an X-Light 310 Type Photographic Densitometer.

In each running processing, the above-mentioned color negative films, i.e., Fuji Color Super HRII-100 and Fuji Color Reala were each processed 0.375 m$^2$ a day, totaling 0.75 m$^2$, over 20 days.

The results of these tests are set forth in Table 9.

The change in magenta stain after 7-day storage was determined in the following manner.

In particular, the color negative films which had been subjected to running processing were allowed to stand at a temperature of 60° C. and a relative humidity of 70% over 7 days. The difference in magenta transmission density on the unexposed portions between the time before and after storage was determined. (Density difference=density after 7-day storage density before storage)

TABLE 9

| | Running Condition | | Results of Properties | | | | | |
|---|---|---|---|---|---|---|---|---|
| | | | Magenta Stain | | Amount of Water Permeation (ml/min) | | | |
| No. | Reverse Osmosis | Additive to Fixing Solution | Shortly after Processing | After 7 days | After 1 Day | After 20 Days | Film Stain | Remarks |
| 41 | None | None | 0.04 | 0.11 | — | — | Fair | Comp. Ex. |
| 42 | Yes | " | 0.04 | 0.10 | 170 | 25 | Fair | Invention |
| 43 | " | S-1 | 0.01 | 0.02 | 165 | 160 | Excellent | " |
| 44 | " | K-1 | 0.02 | 0.03 | 175 | 170 | Excellent | " |
| 45 | " | K-13 | 0.01 | 0.03 | 170 | 160 | Excellent | " |
| 46 | " | K-14 | 0.02 | 0.03 | 175 | 155 | Excellent | " |

In accordance with the present processing method, even if the washing solution and/or stabilizing solution were continuously processed through a reverse osmosis membrane over an extended period of time in a multistage countercurrent process, that fact causes no drop in the permeable amount of solution and no clogging in the membrane. Thus, excellent photographic images can be constantly obtained without any yellow stain shortly after processing and after storage.

While the invention has been described in detail and with reference to specific embodiments thereof, it will be apparent to one skilled in the art that various changes and modifications can be made therein without departing from the spirit an scope thereof.

What is claimed is:

1. A method for the processing of a silver halide photographic material which comprises the steps of, developing a silver halide photographic material which has been previously exposed to light, processing the developed silver halide photographic material with a bath which contains a thiosulfate and which has a fixing ability, and subsequently subjecting the developed silver halide photographic material to washing and/or stabilizing in a multistage countercurrent process which comprises a series of tanks at least one of which contains a reverse osmosis membrane, wherein a washing and/or stabilizing solution, which contains at least one compound selected from the group consisting of a sulfinic acid, a sulfinate and a carbonyl compound-bisulfurous acid addition product and which is located in at least one of the tanks which comprise the washing and/or stabilizing steps, is brought into contact with the reverse osmosis membrane, the portion of the solution which permeates through the reverse osmosis membrane is returned to any of the tanks following the tank wherein the reverse osmosis membrane is located, and the concentrated portion of the solution is returned to the tank in which the reverse osmosis membrane is located.

2. The method for processing a silver halide photographic material as in claim 1, wherein the sulfinic acid comprises a —$SO_2H$ group-substituted aromatic group or heterocyclic group.

3. The method for processing a silver halide photographic material as in claim 1, wherein the sulfinate is a member selected from the group consisting of the following:

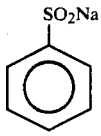

S-1

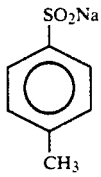

S-2

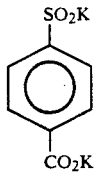

S-36

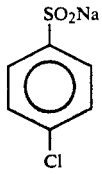

S-42

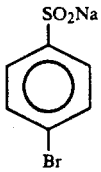

S-43

4. The method for processing a silver halide photographic material as in claim 1, wherein the carbonyl compound for forming the carbonyl compound-bisulfurous acid addition product is an aliphatic carbonyl compound containing 8 or less carbon atoms.

5. The method for processing a silver halide photographic material as in claim 1, wherein the carbonyl compound for forming the carbonyl compound-bisulfurous acid addition product is an aliphatic carbonyl compound containing 1 to 3 carbonyl groups.

6. The method for processing a silver halide photographic material as in claim 1, wherein the carbonyl compound-bisulfurous acid addition product is K-1: Acetaldehyde-bisulfurous acid addition product;

K-2: Propionaldehyde bisulfurous acid addition product;

K-6 Aldehyde succinate-bisulfurous acid addition product;

K-13: D-glycerin aldehyde-bisulfurous acid addition product;

K-14 L-glycerin aldehyde-bisulfurous acid addition product;

K-21 Pyruvic acid-bisulfurous acid addition product;

K-31: Benzaldehyde-o-sulfonic acid-bisulfurous acid addition product;

K-32: Nicotinaldehyde-bisulfurous acid addition product.

7. The method for processing a silver halide photographic material as in claim 1, wherein the sulfinic acid is a compound in which at least one —$SO_2H$ group is connected to an aliphatic acid group, aromatic group or heterocyclic group.

8. The method for processing a silver halide photographic material as in claim 1, wherein the sulfinic acid is a compound in which at least one —$SO_2H$ group is connected to an aromatic group.

9. The method for processing a silver halide photographic material as in claim 1, wherein the sulfinate is a salt of the sulfinic acid with alkali metals, alkaline earth metals, nitrogen-containing organic bases or ammonia.

10. The method for processing a silver halide photographic material as in claim 1, wherein the sulfinate is a salt of aromatic sulfinic acid with an alkali metal or an alkaline earth metal.

11. The method for processing a silver halide photographic material as in claim 1, wherein at least one member selected from the group consisting of a sulfinic acid, a sulfinate and a carbonyl compound bisulfurous acid addition product is incorporated into the washing solution and/or stabilizing solution by adding the member to a prebath having a fixing ability so that it is brought into the washing bath and/or stabilizing bath together with the light-sensitive material to be processed.

12. The method for processing a silver halide photographic material as in claim 1, wherein the washing solution and/or stabilizing solution contains at least one member selected from the group consisting of a sulfinic acid, a sulfinate and a carbonyl compound-bisulfurous acid addition product in an amount of at least 0.0001 mol/l.

13. The method for processing a silver halide photographic material as in claim 1, wherein the multistage countercurrent process is a countercurrent process having three tanks, and the content of the member in the 1st tank is 0.005 to 0.2 mol/l, the content of the member in the 2nd tank is 0.0005 to 0.05 mol/l and the content of the member in the 3rd tank is 0.0001 to 0.01 mol/l.

14. The method for processing a silver halide photographic material as in claim 11, wherein the content of the member in the bath having a fixing ability is 0.01 to 2 mol/l.

15. The method for processing a silver halide photographic material as in claim 1, wherein the reverse osmosis membrane is a membrane which removes NaCl from an aqueous solution containing 2,000 ppm of NaCl at an efficiency of 30 to 90% under the condition of a temperature of 25° C. and a pressure of 5 kg/cm$^2$.

16. The method for processing a silver halide photographic material as in claim 1, wherein the supply pressure of the processing solution to be supplied into the reverse osmosis membrane is in the range of 2 to 20 kg/cm$^2$.

17. The method for processing a silver halide photographic material as in claim 16, wherein the supply pressure is in the range of 3 to 10 kg/cm$^2$.

18. The method for processing a silver halide photographic material as in claim 1, wherein the replenisher of fresh solution is introduced into the respective last tank for the washing solution and the stabilizing solution in an amount of 30 to 200 ml per m$^2$ of light-sensitive material.

19. The method for processing a silver halide photographic material as in claim 1, wherein the development of the silver halide photographic material is a color development.

* * * * *